United States Patent [19]

Stanford

[11] Patent Number: 4,584,809

[45] Date of Patent: Apr. 29, 1986

[54] BEAM FOR SHORING STRUCTURE

[76] Inventor: Joseph S. Stanford, 36 Longfield Rd., Islington, Ontario, Canada, M9M 3G3

[21] Appl. No.: 559,097

[22] Filed: Dec. 7, 1983

[51] Int. Cl.[4] ..... E04C 3/02

[52] U.S. Cl. ..... 52/690; 52/376; 52/729

[58] Field of Search ..... 52/364, 376, 690, 729, 52/696

[56] References Cited

U.S. PATENT DOCUMENTS

| | | | |
|---|---|---|---|
| 1,737,601 | 12/1929 | Macomber | 52/376 |
| 1,951,811 | 3/1934 | Schaffert | 52/376 |
| 3,960,637 | 6/1976 | Ostrow | 52/729 X |
| 4,159,604 | 7/1979 | Burrell | 52/376 |
| 4,191,000 | 3/1980 | Henderson | 52/729 |

*Primary Examiner*—Carl D. Friedman

*Attorney, Agent, or Firm*—Donald E. Hewson

[57] ABSTRACT

The beam disclosed has a bulky wooden top flange, an extruded aluminum bottom flange, and a plywood web. The web is tailed-in to the two flanges to form a unitary whole. The structure takes advantage of the rigidity of wood under compression and the strength of a slim extruded section of aluminum under tension.

17 Claims, 1 Drawing Figure

BEAM FOR SHORING STRUCTURE

BACKGROUND TO THE INVENTION

This invention relates to beams for shoring structures, the main use of such structures being to serve as a temporary support during the formation of concrete slabs.

The beams for shoring structures must first of all be strong enough, so that they will not fail under the weight of the concrete even under abusive conditions. Apart from that paramount requirement, the beams should be light in weight for easy assembly and removal of the shoring structure as the building progresses: and since many beams are needed to support a large concrete slab, each beam also should be inexpensive in itself, and should be easily manufactured in production quantities.

PRIOR ART

An example of a typical stringer that has been used hitherto is that shown in Canadian Pat. No. 1,106,127 (Johnston, Aug. 4, 1981). The beam is formed as an aluminum extrusion. The cross-sectional shape of the extrusion includes a bottom flange having a wide, flat, thin base; a comparatively slender web; and a channel-shaped top section in the form of an inverted top hat. A strip of wood fits into the upper top hat channel and is provided for the purpose of receiving nails or screws so that a decking board may be nailed down to the top of the beam. The strip of wood is secured in the top hat channel by screws which pass through the sides of the channel. This Johnston stringer is, itself, an improved and more robust design compared with those shown in Avery U.S. Pat. Nos. 4,144,690 (Mar. 20, 1979), 3,899,152 (Aug. 12, 1975) and 3,787,020 (Jan. 22, 1974).

In U.S. Pat. No. 4,159,604 (Burrell, July 3, 1979) the wooden strip is secured by barbs formed in the sides of the trough. It is plain that in such arrangements the capacity of the wood to contribute to the structural strength and stiffness of the beam is quite limited: when the beam deflects under load, there is some relative movement between the wood and the metal permitted by such jointing means as those illustrated.

It is also known from U.S. Pat. No. 4,191,000 (Henderson, Mar. 4, 1980) to provide a composite beam for shoring structures in which the beam is made entirely of wood. The top and bottom flanges are rectangular sections of wood in which the grain runs along the length of the beam. The flanges are joined by a web of wood that is "tailed-in" to both flanges, i.e., slots are cut in the flanges and complementary tails on the web are a tight fit in the slots, and are glued into the slots. In this case, the joint between the web and the flange is a very strong one: now, the wood of a flange cannot deflect or flex independently of a corresponding flexure in the web. The strength of the web therefore complements

BRIEF DESCRIPTION OF THE INVENTION

It is recognized by the present invention that the performance of a beam as a shoring support can be enhanced by a combination of features from the two types of previous construction as described above. It is recognized that wood is well-suited for taking compressive forces: its bulk ensures that it resists buckling under compression, and the disruptive induced shear stresses which would be incurred during such buckling.

In a beam, it is bad practice on the other hand to employ wood in tension: wood can have knots in it which seriously reduce its tensile strength (though they hardly affect its rigidity under compression.) Since the beam cannot be allowed to fail, the designer must allow a huge factor of safety, which is not needed when the wood is only in compression.

Other materials have other characteristics: aluminum, or other extruded materials, cannot have a thick and bulky section as that would be too expensive. It is uneconomical for extruded shapes to be anything but thin, though, of course, the shapes can be intricate. These shape characteristics mean that whilst an extruded shape is much superior to wood in supporting tensile forces, wood is the one that is more suited to taking compressive forces, at least with the type of loading and the manner of use encountered in beams for shoring structures.

In the invention, the top flange of the beam (which is under compression when the beam is loaded) is wood, and the bottom flange (which is under tension) is extruded. The flanges are joined by a web that renders the beam a unitary whole. Such a beam can be used in the same manner as the known beams with the all-extruded section and a wood insert, since a wooden surface is presented on top for the nailing down of boards, and the extruded shape of the bottom flange can include the customary T-slots for retaining bolts.

Preferably, the two flanges are joined to the web by tailing-in the web, which is conveniently of a laminated or sandwich construction. The tails can be provided on the bottom flange by appropriate shaping of the extruded section.

DETAILED DESCRIPTION OF THE PREFERRED EMBODIMENT

Figure 1:
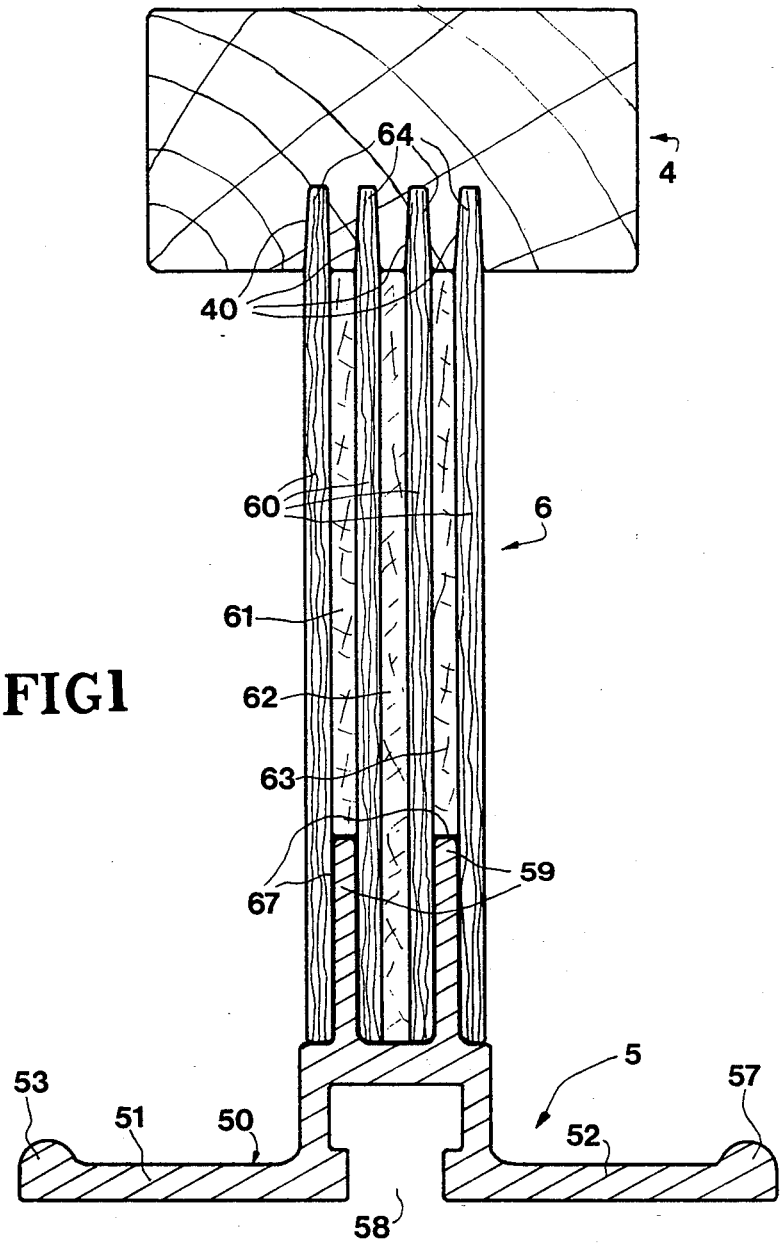

An exemplary embodiment of the invention will now be described with reference to the accompanying drawing, in which:

FIG. 1 is a cross-section of a beam that embodies the invention.

The beam of FIG. 1 includes a top flange 4, a bottom flange 5 and a web 6. The top flange 4 is of wood, arranged with its grain disposed along the length of the beam, i.e., perpendicular to the plane of the FIGURE. The bottom flange 5 is of aluminum and the cross-section shown in the FIGURE has the shape in which the aluminum was extruded.

The extruded shape of the bottom flange 5 includes a wide base 50 comprised by the two limbs 51, 52. Each limb has a respective bead 53, 57 at its extremity. The extruded shape includes a T-shaped slot 58 that runs the length of the beam. Protruding upwards from the material on top of the slot 58 are two tails 59.

The top flange 4 is made of wood of a rectangular section. Four slots 40 are cut in the undersurface of the flange 4. The slots 40 are slightly tapered.

The web 6 has seven plies; in the plies 60 the grain runs vertically, whereas in the plies 61, 62, 63 the grain runs along the length of the beam. The lengthwise-grained plies 61, 62, 63 are cut away at the top of the web, so as to leave tails 64 that extend from the plies 60. Part of the vertically-grained plies 60 are also cut away to leave the tails slightly tapered. The two outer lengthwise-grained plies 61,63 are cut away at the bottom of the beam, to leave slots 67.

To assemble the beam, the tails 64 on top of the web 6 are inserted into the slots 40 in the top flange 4. The tails 59 on the bottom flange 5 are inserted into the slots 67 in the bottom of the web 6. Each tail is made a good tight fit in its respective slot so that the components of the beam have to be pressed together to bed down the tails fully into the slots. The tails and slots are glued during assembly. This manner of joining components of beams together is known as "tailing-in". It produces a joint of generally greater strength than the materials of the components (i.e., if the beam fails, it very rarely does so at the joints). The slots and tails should be accurately made to ensure a good fit, but there is little problem in this regard once a production set-up has been made: the wooden components can be milled to shape using suitable jigs and fixtures whilst the extruded component is precise enough as extruded. When made properly, the joint permits absolutely no relative movement between its components: any flexure of the one must be accompanied by a commensurate flexure of the other.

It is recognized in the invention that tailing-in an extruded to a wooden component produces a joint between the two of the required strength and reliability, yet with no great expense.

In use, quantities of beams are assembled in such a way that flat boards may be laid on top, and nailed down to the beams. The top-flange 4, being of wood, readily accepts nails or screws. If desired, cross-braces can be installed between beams and nailed to the exposed sides of the rectangular shape of the top flange 4. (In the all-extruded beam of the prior art, even with the wood insert, the assemlby had to be carried out on the basis that cross-braces could not be attached between the beams, because the sides of the wood insert were not exposed.)

The beams of the invention are light enough for them to take their place in shoring structures of the flying variety. Here, the beams are assembled to provide a shoring structure on which a concrete floor is poured, in the usual way; but when the concrete has set, the shoring structure is not dismantled but is caused to slide bodily horizontally until clear of the floor on top of it. It is then lifted by crane, and laid upon an upper floor so as to be ready to shore another concrete floor without delay.

Since the flying shoring structure has to be lifted substantially at the limit of the crane's reach, it is very important that the structure should be light; and the strength-to-weight ratio of the beam of the invention is very good as compared with prior art beams. The stress in a shoring structure whilst it is being flown from the crane can cause the structure to distort: the ability of the beam of the invention to receive cross-braces or bridging-braces between the beams means that the structure can easily be given the required stiffness that it needs to survive the flying operation without damage.

Other refinements of the beam of the invention include the provision of the beads 53,57 at the extremities of the base 50. These beads receive clamping clips to hold the beam down onto another beam acting as a stringer running cross-wise below, or onto other suitable supports; or for securing other parts such as panforms to the beam. The beads 53, 57 also act to concentrate the mass of the base at the edges, for good strength and stability.

The undersurface of the base 50 may be slightly concave to ensure good stability of the base.

The T-slot 58 is provided to receive the head of a bolt, also for holding the beam down onto its support, or for mounting and hanging other parts from the beam.

With the invention, some degreee of versatility is provided. The extruded shape of the bottom flange 5, being extruded might be difficult to change, but the top flange and the web can be readily changed. Similarly, if the wooden parts deteriorate, the extruded part can be fitted with new wooden parts. The web 6 itself has a good deal of bulkiness as compared with the slender web of the all-extruded beam, which means that the web can be taller, without the web being liable to a buckling failure.

The beam has been described when used horizontally and with the wood flange upmost. In shoring structures, sometimes the beams need to be disposed vertically or horizontally with the flanges at the sides. This can be appropriate when shoring walls or columns for instance. The beam of the invention can still be used in such circumstances, though it should of course be arranged that the properties of the beam are used to the best advantage in that the bulky wooden flange is the one that is predominantly in compression and the comparatively slim-sectioned extruded flange is the one that is predominantly in tension.

The material of the extrusion may be other than aluminum. It could be titanium, or it could be a glass-filled plastic resin. The material of the web may be other than plywood, in that the plies that comprise the tails could be of metal or plastic. There may be more or fewer plies than seven. Likewise, instead of the two tails 59, a single extruded tail could be accommodated in a single machined slot at the lower end of the web.

What is claimed is:

1. Beam, having a top flange, a bottom flange, and a web;

wherein the top flange has a cross-sectional shape that is characterised as bulky, having a substantial height and width, and is made of wood;

wherein the bottom flange has a cross-sectional shape that is characterised as non-bulky being in comparatively slim portions and includes a wide, base portion, and wherein the bottom flange is formed by the extrusion of an homogeneous material; and wherein the flanges are joined to the web in such a manner that the two flanges and the web are as one, and together comprise a unitary force-transmitting structure, in that the joint between each flange and the web is so firm and rigid that flexure or strain of the flanges cannot take place independently of a commensurate flexure or strain of the web;

wherein the web is tailed-in to the top flange, in that at least one slot is formed in the top flange and complementary tails or a tail are formed on the web, and the web is joined to the top flange by glueing the complementary tail or tails into the slot or slots.

2. Beam of claim 1, wherein the material of the top flange is wood of a rectangular cross-section, the top and the two side surfaces of the material of the top flange being exposed.

3. Beam of claim 2, wherein a bolt slot is formed lengthwise of the beam in the bottom surface of the bottom flange, and is centrally located therein.

4. Beam of claim 1, wherein the web comprises plies of material in sandwich or laminate form, disposed so that plies extend between the two flanges, and wherein the tails comprise alternate plies.

5. Beam of claim 4, wherein the tails for joining the web to the top flange are comprised by alternating plies of wood in which the grain runs from flange to flange.

6. Beam of claim 1, wherein the web is tailed-in to the bottom flange, in that at least one slot is formed in the web and complementary tails or a tail are formed as part of the extruded cross-sectional shape of the bottom flange, and the web is joined to the bottom flange by glueing the tail or tails into the slot or slots.

7. Beam of claim 6, wherein a bolt slot is formed lengthwise of the beam in the bottom surface of the bottom flange, and is centrally located in the bottom flange.

8. Beam of claim 7, wherein the bottom flange has two tails.

9. Beam of claim 7, wherein the material of the bottom flange is extruded aluminum.

10. Beam of claim 7, wherein the web comprises plies of material in sandwich or laminate form, disposed so that plies extend between the flanges, and wherein the slots comprise cut-outs in non-adjacent plies.

11. Beam of claim 10, wherein the slots for joining the web to the bottom flange are cut from alternating plies of wood in which the grain runs along the length of the beam.

12. Beam of claim 10, wherein the joint between the web and the bottom flange further comprises means for clamping the plies of the web firmly to the tails on the bottom flange.

13. Beam of claim 1, wherein the material of the bottom flange is extruded aluminum.

14. Beam of claim 2, wherein the web comprises plywood.

15. Beam of claim 2, wherein the web comprises a sandwich or laminate of alternating layers of wood and metal.

16. Beam of claim 1, wherein the material of the bottom flange is extruded plastic containing fillers or inclusions to improve the tensile strength of the plastic.

17. Beam of claim 1, wherein the material of the bottom flange is extruded titanium.

* * * * *